US006824459B1

(12) United States Patent
Suquitana

(10) Patent No.: US 6,824,459 B1
(45) Date of Patent: Nov. 30, 2004

(54) GOLD JEWELRY LAPPING MACHINE WITH SHROUD

(76) Inventor: Manuel Rodrigo Suquitana, 540 W. 52nd St., Apt. 5H, New York, NY (US) 10019

( * ) Notice: Subject to any disclaimer, the term of this patent is extended or adjusted under 35 U.S.C. 154(b) by 0 days.

(21) Appl. No.: 10/642,965

(22) Filed: Aug. 18, 2003

(51) Int. Cl.[7] ..... B24B 55/04

(52) U.S. Cl. ..... 451/453; 451/456; 451/359; 451/550; 30/124; 30/391

(58) Field of Search ..... 451/87–89, 453, 451/456, 359, 388, 550, 905; 30/390, 391, 124

(56) References Cited

U.S. PATENT DOCUMENTS

| | | | | | |
|---|---|---|---|---|---|
| 1,374,075 | A | * | 4/1921 | Graham | 451/453 |
| 1,393,892 | A | * | 10/1921 | Luden | 451/453 |
| 2,667,017 | A | * | 1/1954 | Jaron | 451/456 |
| 2,749,681 | A | * | 6/1956 | Reidenbach | 451/527 |
| 3,307,299 | A | * | 3/1967 | De Beer | 451/453 |
| 4,120,121 | A | * | 10/1978 | Surman | 451/28 |
| 4,316,645 | A | * | 2/1982 | Korwin | 312/212 |
| 4,373,300 | A | * | 2/1983 | Partridge | 451/453 |
| 4,811,527 | A | * | 3/1989 | Ruopsa | 451/453 |
| 5,125,190 | A | * | 6/1992 | Buser et al. | 451/456 |
| 5,971,839 | A | * | 10/1999 | Schmelzer | 451/456 |
| 6,159,086 | A | * | 12/2000 | McClurkin | 451/453 |

* cited by examiner

*Primary Examiner*—George Nguyen
(74) *Attorney, Agent, or Firm*—Amster, Rothstein & Ebenstein LLP

(57) ABSTRACT

A lapping machine operable with a lap wheel for lapping gold jewelry and adapted to collect gold dust produced by the lapping machine, includes: (a) a base, (b) an electric motor mounted to the base, the electric motor having a rotatable output shaft extending upward and adapted to be coupled to the lap wheel which is situated above the electric motor and rotates about the axis of the output shaft, with a gold dust debris space defined as the area surrounding the lap wheel and extending from below the lap wheel downward and surrounding at least part of the output shaft, (c) a shroud comprising rear and opposite side parts that surround the rear and opposite sides of the gold dust debris space respectively, thus leaving the front of the gold dust debris space open and accessible, the shroud including a continuous front wall and a continuous rear wall spaced radially outward of the front wall, with air flow passages defined between the front and rear walls of the rear and side parts, the front walls of the side and rear parts of the shroud having a plurality of apertures which comprise a majority of the surface area thereof, (d) a first air exhaust port in the rear wall of the rear part of the shroud at an elevation below the bottom of the lap wheel, the air flow passages in the side parts of the shroud communicating with the air flow passage in the rear part and with the first air exhaust port, and (e) exhaust air suction means communicating with the first air exhaust port for drawing air and gold dust from the gold dust debris area.

24 Claims, 7 Drawing Sheets

71
45
95
25
94
38
72
49
59
74
76
19
60
65
44
58
26
39
44
44
44

GOLD JEWELRY LAPPING MACHINE WITH SHROUD

FIELD OF INVENTION

This invention is in the field of lapping, grinding and related machine tools that produce dust particles, and particularly to lapping, grinding, polishing and related machines used with gold jewelry and that produce gold dust debris, and dust collectors for such machines.

BACKGROUND OF THE INVENTION

In the jewelry making art there are many variations of high speed rotary grinding, lapping, polishing and related machines that produce dust debris of gold, silver and other precious metal particulate removed from the articles being machined. Associated with these machines are various dust collectors which utilize an air flow to direct the dust away from the machines with the metallic particulate captured downstream in filters. For convenience in this application, the term lapping machine and lap wheel will represent all these machines, since the new dust collectors disclosed herein can be used with any of these machines even though it is intended primarily for use with gold jewelry lapping machines. Such lapping machines discharge a substantial quantity of gold dust into a debris area adjacent the spinning lap wheel and from there into the close vicinity of the operators of such machines. Usually a dust collection apparatus is associated with or incorporated into the lapping machine for the purpose of collecting this gold dust.

Two main concerns about the gold dust are: (a) that it may be a dangerous pollutant to persons, animals or plant life in the vicinity, and (b) that the gold in this dust often has a considerable value that may be lost to the owners of such machinery. Also, the presence of the gold is an enticement to the operators of this machinery or to others to steal it, because of its significant value and because it is lying on the walls of the equipment where the dust has landed and can be simply wiped off with a rag or sponge. Gold extracted from this dust is readily saleable for approximately $350.00 a pound or whatever is the current price being variable with the relevant market.

Thus, for the reasons of danger to persons, animals and to the environment by this dust and for the lost value of uncollected gold, gold dust collection apparatus has been developed to reduce both of these problems.

Prior art dust collecting apparatus includes hoods and shrouds which either fully surround the work area where the dust is generated or only partially surround the area when open access to the area by an operator is required. Some dust collecting machines are as simple as a shroud or hood against which the dust strikes and falls down onto the floor of the dust collector or onto the floor of a room. Most dust collectors have suction devices attached to the shroud for drawing the dust and particles therein out of the debris area and into a collection container which usually has a filter. Such filters are periodically cleaned of the gold in a variety of routine ways.

A problem with typical gold dust collection machines is that a significant amount of gold dust is deposited on the wall surfaces and screen surfaces of the shroud or is deposited on internal walls of the conduits where the dust flows. Some gold dust is thus not readily collectable, and the visible or available gold dust becomes attractive to workers who can simply wipe it off the walls of the apparatus and consolidate it into manageable masses for subsequent sale.

In a large jewelry-making factory the amount of gold dust lost to the factory owners or lost into the environment can be very significant.

One prior patent, U.S. Pat. No. 1,393,892 to Luden, for example, has a dust collector formed of inner and outer concentric walls generally surrounding the gold dust debris area. Some gold dust is captured by a liner along the inside of the inner wall; however, such a liner and collected gold can be easily stolen, and furthermore, this system does not remove the dust to a place remote from the work area.

Another prior art patent, U.S. Pat. No. 965,223 to Plant, discloses a dust gathering device which partially surrounds the abrading machine's work area. The portion of this machine has a few openings in the inner wall, with the majority of this inner wall being solid material on which gold dust would become deposited if this machine were used for machining of gold jewelry. Gold could be easily wiped from these exposed surfaces, and this represents the typical kind of prior art problem that the present invention seeks to avoid.

A third prior art patent, Russian No. SU 1055-633-A to Kozlov, discloses a grinding tool on a horizontal shaft. Dust is circulated within this hood and collected on a peripheral filter within a hood as opposed to being exhausted externally of the hood.

Many dust collecting apparatus are not designed for use with a rotating grinding or polishing wheels which spin and direct the dust and debris radially outward from the work surface, and thus they are not concerned with the problems of dust being directed in a great multitude of directions.

The present invention pertains primarily to high speed rotating lap wheels which spew gold dust in many directions and to associated gold dust collection apparatus.

OBJECTS AND SUMMARY OF THE INVENTION

The new invention is a gold dust collector for use with lapping, grinding, polishing or related apparatus, particularly as used with gold jewelry. Typically, such apparatus has a base with an electric motor on the base and a drive shaft extending generally upwardly. As mentioned earlier, this invention will be described with respect to a lap wheel machine, but the invention is applicable to other machines with produce metal particulate and other dust debris. Attached to this drive shaft is a lap wheel that extends perpendicularly to and spins about the drive shaft axis. The jewelry piece being lapped is held by an operator below the wheel and pressed upward against it. During such lapping, particles of gold dust are thrown and spewed downward and outward, either radially or at an angle because of the rotational motion of the wheel.

In the new invention a shroud has a back and sides that partially surround the gold dust debris area which is the space primarily below the lap wheel and slightly above it. This shroud has a front wall radially spaced from the drive shaft and a rear wall spaced radially outward from the front wall, thus defining an air passageway between front and rear walls. The front wall is highly perforated to allow a maximum flow of air through the perforations and into the passageways between said front and rear walls. In the rear wall is a first exhaust port in communication with an exhaust fan or other exhaust air flow means. Thus, an air flow is established from the gold dust debris area at least below the lap wheel, outward to the perforated front wall of the shroud, then through the apertures in this wall, into the flow passages between the front and rear walls, then through the first exhaust port and finally to a filter downstream of this exhaust port. The air flows at sufficient cubic feet per minute to entrain or carry the gold dust particulate, so that at least most of the gold particulate is entrained and carried by the air flow to the terminal collection and substantially does not strike and stick to the walls of the passageways.

The shroud is open at the front to allow easy access by an operator to the front portion of the lap wheel, where the operator presses an article to be lapped upward against the bottom of the lap wheel near the front outer peripheral area thereof. In a preferred embodiment there is an additional or second exhaust port in one of the sides of the shroud situated to capture gold dust from the initial contact of the jewelry with the front of the wheel. The first exhaust port is in the rear center of the shroud at an elevation below the lap wheel, and the second exhaust port in this embodiment is in one of said side walls at an elevation at least partially below said lap wheel, and optimally at an elevation partially below and partially above said lap wheel.

In another preferred embodiment, the front wall of the shroud is formed of a wire grid material such as fence wire. The apertures defined by the wire grid are sufficiently small to prevent an operator's fingers from reaching through to obtain any of the gold, but otherwise are as large as possible to allow the maximum flow of air therethrough.

In a still further embodiment the rear wall of the shroud is perforated leading to a manifold rearward of the rear wall that collects and directs the gold dust to an exhaust duct. These perforations may be louvers directed generally downward into the manifold.

In a typical embodiments the electric motor rotates the lap wheel at a speed of approximately 3450 rpm which is one standard in the industry. This lap wheel has four slits extending radially inward from the outer periphery, with each slit spaced apart by 90° from adjacent slits. When a wheel of this type with the slits is rotated at a speed of 3450 rpm, the optics of the system are such that the user can see through the slits while the wheel is spinning and see with reasonable clarity the jewelry being held by his or her hands beneath the wheel as the jewelry is being lapped.

It is an additional object of this invention for the exhaust means to provide an air flow sufficient to entrain the gold dust particles, so that these particles are carried by the air and do not drop down to the floor of the air flow passage and do not leave the air flow and strike and adhere to the walls of the air flow passage.

According to one embodiment of this invention, a gold lapping machine operable with a lap wheel includes:

(a) a base, (b) an electric motor mounted to said base, said electric motor having a rotatable output shaft extending upward and adapted to be coupled to said lap wheel which is situated above said electric motor and rotates about the axis of said output shaft, with a gold dust debris space defined as the area surrounding said lap wheel and extending from below said lap wheel downward and surrounding at least part of said output shaft, (c) a shroud comprising rear and opposite side parts that surround the rear and opposite sides of said gold dust debris space respectively, thus leaving the front of said gold dust debris space open and accessible, said shroud comprising a continuous front wall and a continuous rear wall spaced radially outward of said front wall, with air flow passages defined between said front and rear walls of said rear and side parts, said front walls of said side and rear parts of said shroud having a plurality of apertures which comprise a majority of the surface area thereof, (d) a first air exhaust port in said rear wall of said rear part of said shroud at an elevation below the bottom of said lap wheel, said air flow passages in said side parts of said shroud communicating with said air flow passage in said rear part and with said first air exhaust port, and (e) exhaust air suction means communicating with said first air exhaust port for drawing air and gold dust from said gold dust debris area.

In one embodiment of this invention the shroud front and rear walls are formed as concentric semi-circular surfaces, with the air flow chamber between them being also a concentric arc. In another embodiment of this invention the front and rear walls are formed of a plurality of flat panels which together form a generally concave enclosure.

The present invention is available in a plurality of embodiments, including: (1) a lapping machine with the new shroud for gold jewelry, (2) a similar lapping machine for articles of any material that produces dust, and (3) a shroud alone for use with any lapping machine. Of these embodiments, there are table models that sit on a table or counter and exhaust at that level, and other models that may be mounted to a bench and exhaust down to floor level. Furthermore, the shroud may comprise merely a perforated front wall and a non-perforated rear wall, or perforated front and rear walls with a rear manifold behind the rear wall to collect the outflow of air and entrained dust particulate. In one embodiment the perforated front wall of the shroud is a wire fence with apertures that occupy at least a majority of the surface area. In typical embodiments the exhaust air flow system comprises a first exhaust port generally at the rear of the shroud in combination with a second exhaust port in one side of the shroud near the front, the second port located to received directly the dust particulate spewed from contact with the front of the lap wheel. Additional embodiments are described in detail below and recited in corresponding claims.

The drawings appended hereto and described herein disclose preferred embodiments which are illustrative of the features and functions of the present invention but do not limit the scope and claims to the structures shown.

DETAILED DESCRIPTION OF THE PREFERRED EMBODIMENTS

Figure 1:
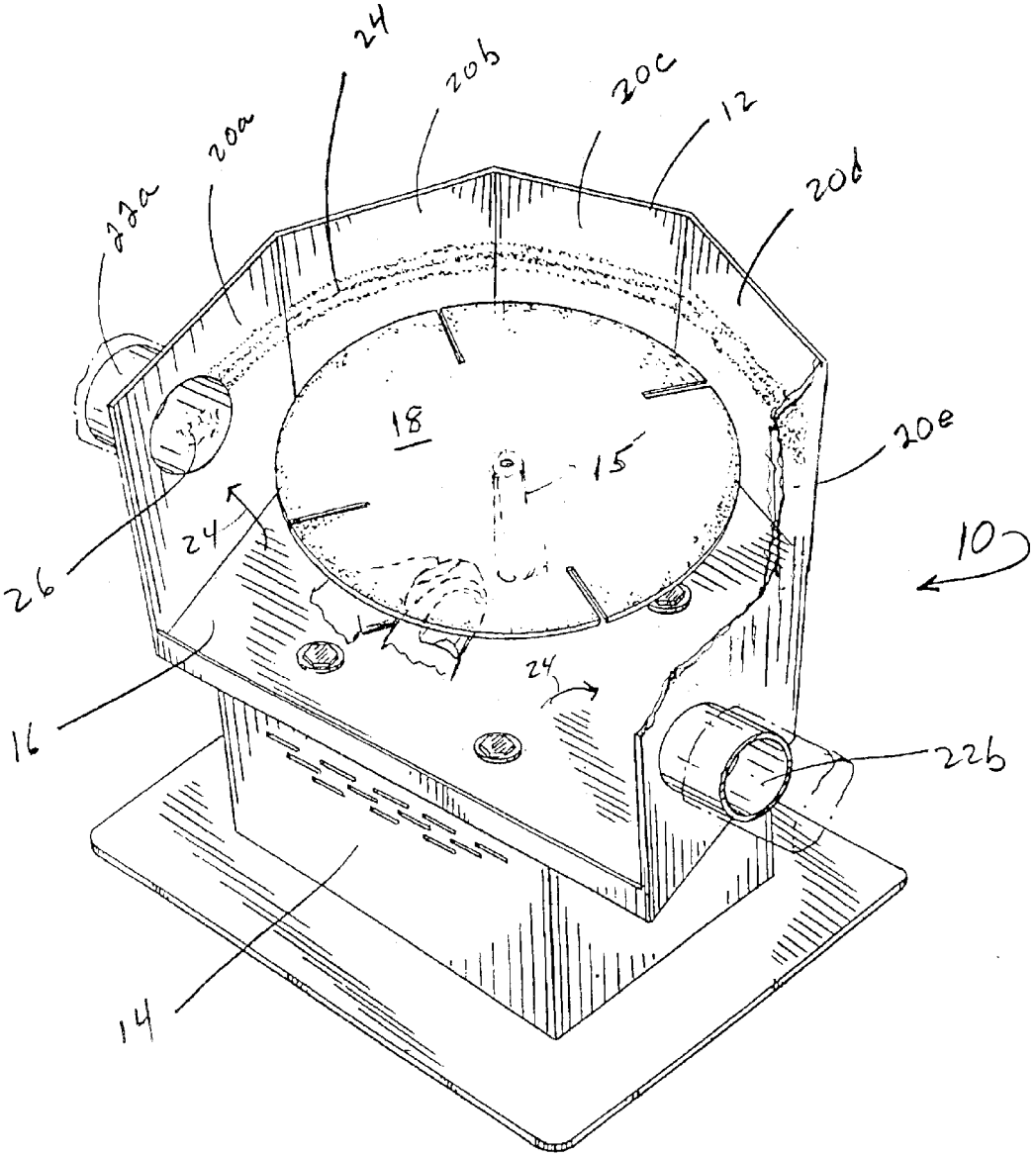
FIG. 1 (PRIOR ART)
FIG. 1 is a top front perspective view shown schematically of a prior art gold jewelry lapping machine with a shroud.

FIG. 1 illustrates a typical prior art lapping machine 10 with a shroud 12 above a base 14, an electric motor (not shown) within the base, and an upstanding vertical drive shaft 15. Above the base is housing 16, split lap wheel 18 and panels 20*a*–20*e* of the shroud 12. In panels 20*a*and 20*e* are air outlet ports 22*a* and 22*b* respectively in communication with an exhaust air flow fan (not shown). Notwithstanding the presence of the exhaust air flow ports 22*a* and 22*b* which draw gold dust from the gold dust debris area below and adjacent the lap wheel 18, a substantial amount of gold particulate is spewed as paths 24 onto the exposed wall surfaces of shroud panels 20*a*–20*e* . Additional gold particulate 26 is deposited on the inner walls of the exhaust air ports 22*a* and 22*b*. And still further gold dust is not captured by the air flow out the exhaust air ports and becomes dispersed into the air and environment adjacent this machine. The new invention is focused particularly on the paths of gold particulate 24 which are readily visible and readily removable by unauthorized operators of these machines. The new invention is also focused, of course, on the dispersal of gold dust into the atmosphere.

FIGS. 2, 3, 4 and 5 show a first embodiment 30 of the new invention which includes a housing or base 32, an electric motor 34 which rotates its output or drive shaft 36 at 3450 rpm. Secured to this drive shaft is a lap wheel 38 having top side 39, bottom side 40, outer peripheral edge 42 and slits 44 which extend from said outer peripheral edge 42 radially inward approximately one half of the way toward the center. A wheel with radical slits rotating at 3450 rpm will produce the optical effect of visibility through the wheel, whereby the operator can see the article being lapped below the lap wheel.

In operation, an article of jewelry 45 is held by an operator in the work area 46 below the lap wheel in the exposed front area of the machine where the operator presses the jewelry upward against the bottom side 40 of the lap wheel 38, with a result that gold dust and debris 47 is spewed by the wheel primarily outward and downward. The cylindrical area 46 primarily beneath and partially above the lap wheel 38 and surrounding the drive shaft thus becomes the gold dust debris area 48, with gold particles and gold dust flying about and outward.

To contain and collect this gold dust a shroud 50 is established that encompasses the sides and rear of the gold dust debris area 48, while the work area 46 remains open at the front for the operator to position his or her hands beneath the lap wheel. Also, the top remains open or covered by a window for the operator to see clearly the lapping operation. This shroud is a wall that generally surrounds the rear and sides of the gold dust debris area 48 with the front remaining open for easy access to the lap wheel by an operator. This shroud is constructed of a front wall 52 and a rear wall 54 spaced generally radially outward of the front wall, with an air passageway 56 defined between these front and rear walls. Substantially, the entire surface of front wall is highly perforated, by forming this wall of a wire mesh 58 such as chicken wire. In this preferred embodiment the upper apertures 52A are approximately 1 inch×1 inch, and the lower apertures 52B are approximately 1 inch×½ inch. The wire has a diameter of about one mm. This perforated front wall may be formed in a variety of other ways; however, in this first preferred embodiment said apertures define a majority of the area of said front wall.

Figure 3:
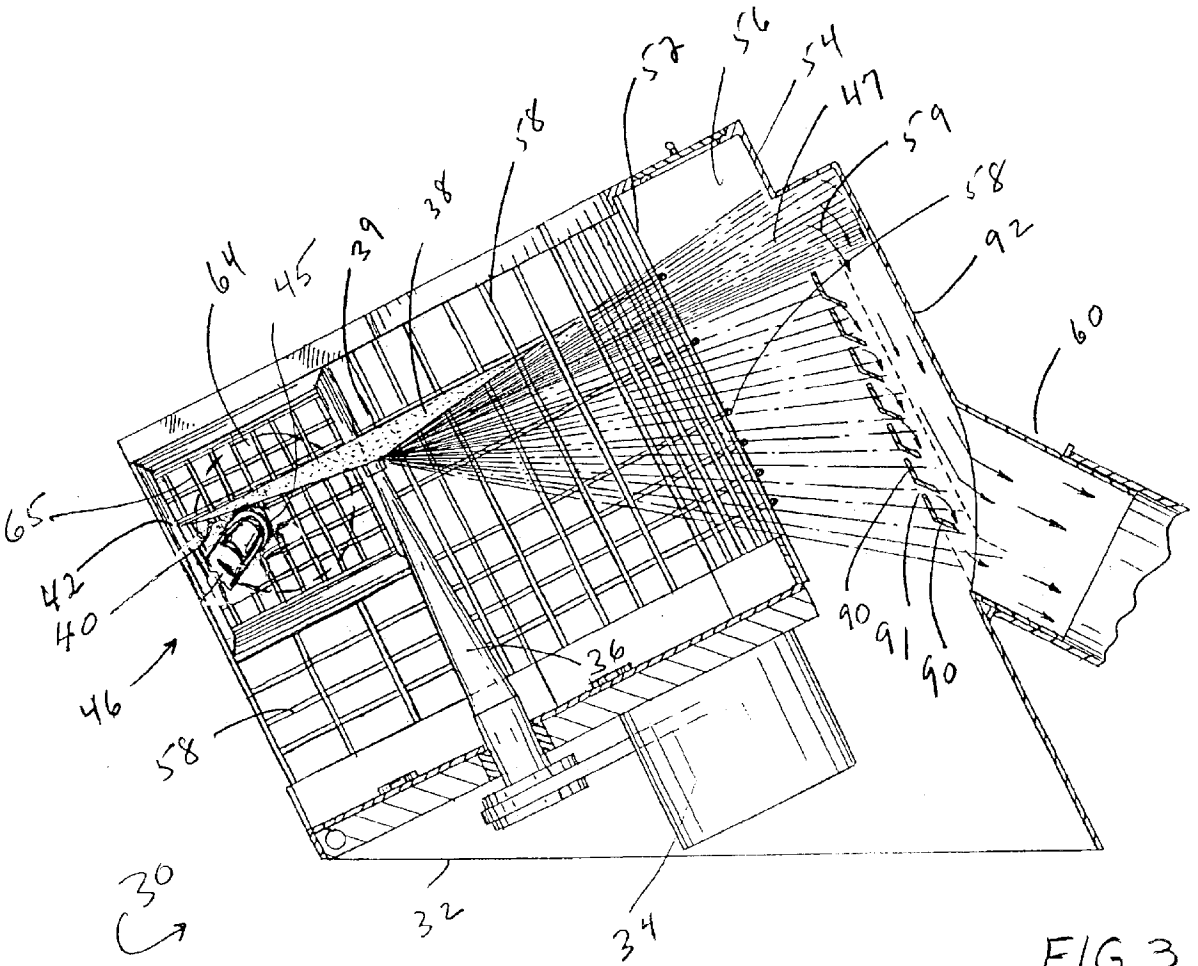
FIG. 3 is an elevation view in section taken along line 3-3 in FIG. 2.
Figure 4:
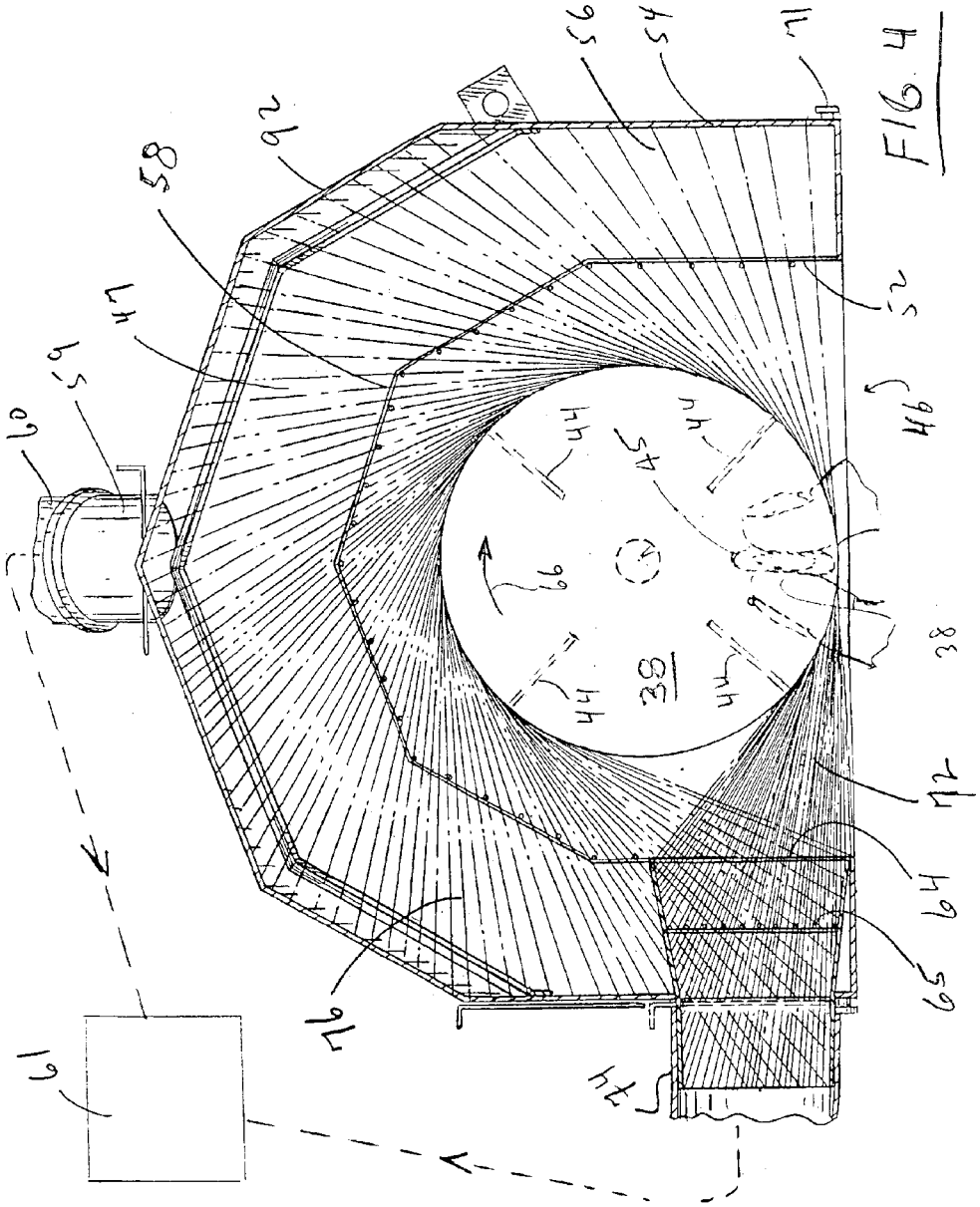
FIG. 4 is a top plan view of the gold jewelry lapping machine in FIG. 2 with air flow lines shown schematically.
Figure 5:
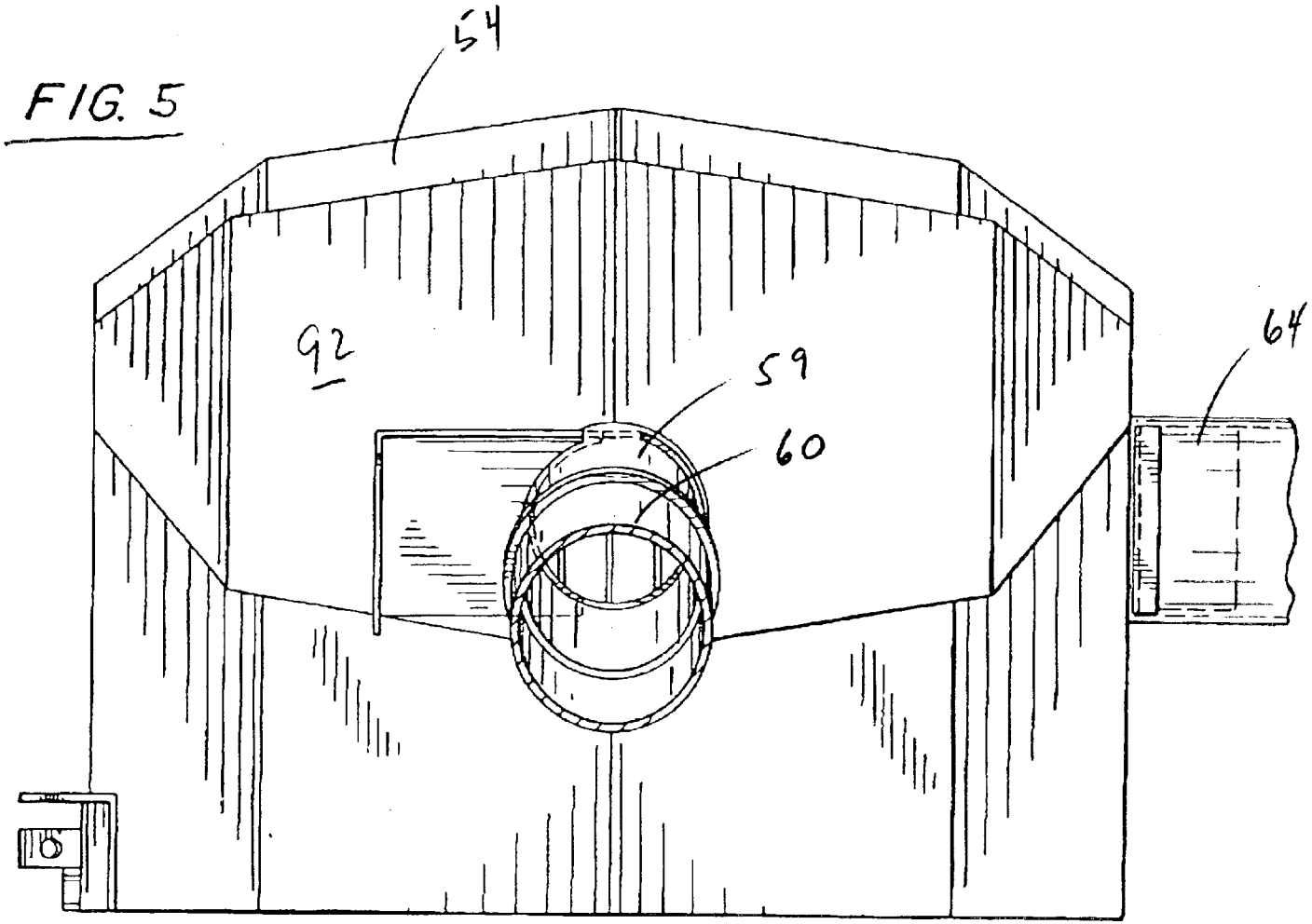
FIG. 5 is a rear elevation view of the gold jewelry lapping machine of FIG. 2.

Also in the embodiment, as seen in FIGS. 3, 4 and 5, the rear wall 54 is perforated by louvers 90 with spaces 91 between the louvers. Outward and rearward of the louvers is an outer rear wall 92 which serves as a manifold to collect the air flows through the spaces 91 between the louvers. The manifold then directs the air flows to the exhaust port 59 and exhaust duct 60 seen in FIGS. 3, 4 and 5 at the center rear of outer wall 92.

The air exhaust air port 59 connected to duct 60 has its remote end in communication with an exhaust air fan, blower or other air suction means including a filter to capture the gold dust, shown schematically as block 61. By this arrangement of air suction at air exhaust port 59 an air flow is established inward through said plurality of perforations in said front wall 52, along said passageway 56 on both sides of the shroud, out said louvers 90 and thence out said air exhaust port 59 through the exhaust duct 60 to the collection filter. Gold particulate in the gold dust debris area is drawn and entrained into this air flow and carried through air passages 56.

Figure 2:
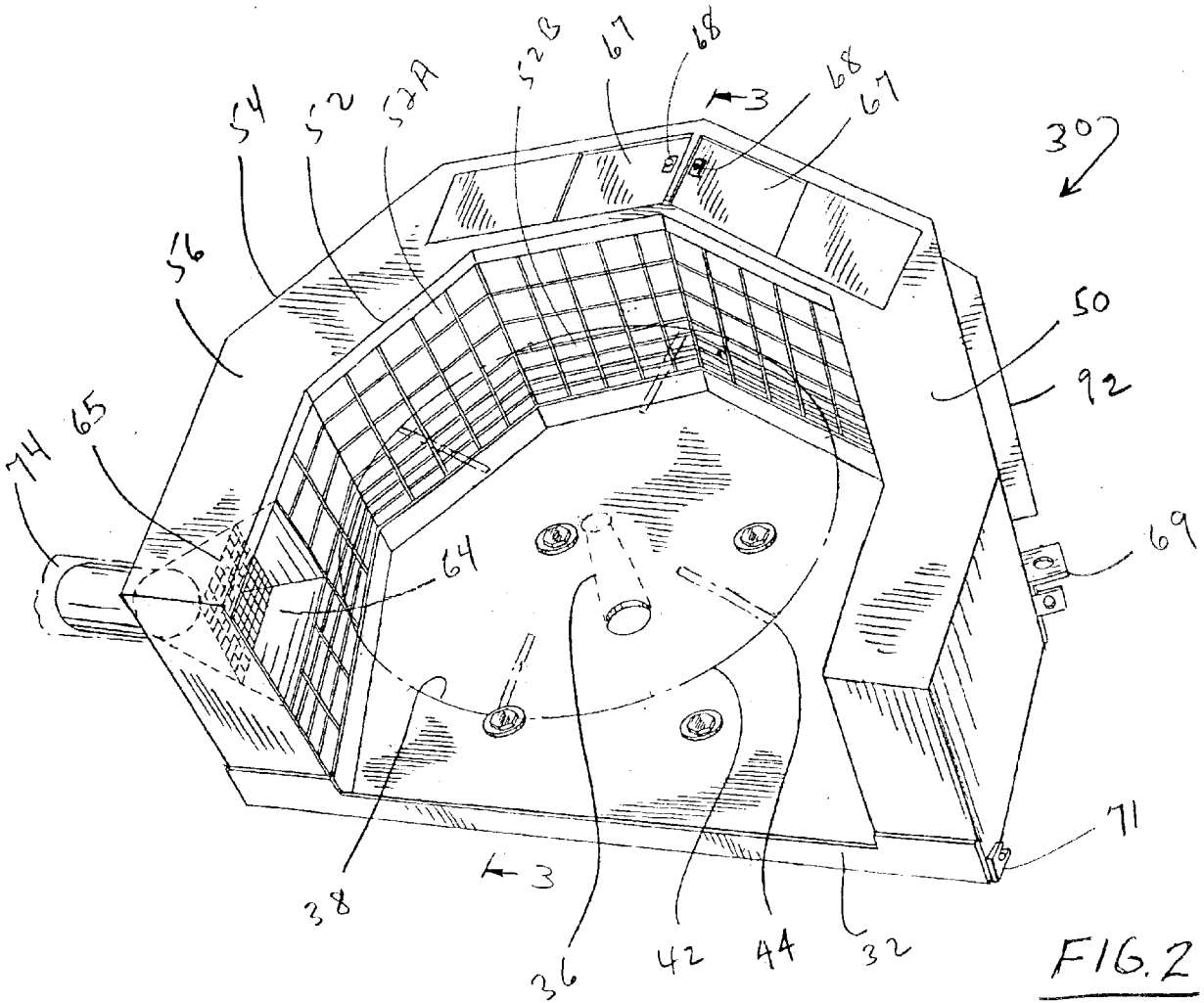
FIG. 2 is a top front perspective view shown schematically of a first embodiment of the new gold jewelry lapping machine with a shroud.

As seen in FIGS. 2–4, to enhance this air flow arrangement, a second air exhaust port 64 is established near the front right side of the shroud in the rear wall thereof. The exhaust air suction means 61 is connected to this second air exhaust port 64, and later combined with the air flow from the first duct 60 before flowing into the filter. Within port 64 is a stainless steel screen 65 which has a first function to catch and save jewelry which has accidentally been sucked into the port, and a second function as a barrier to prevent operators from hiding jewelry in the port for later retrieval.

By this arrangement the gold dust passes through the front wall of the shroud where the wire grid is a small fraction of the surface, and very little gold becomes deposited on the wire. By the entrainment substantially all the gold dust is carried through and out of the air passage 56, as opposed to becoming deposited on the rear wall of the passage or deposited elsewhere in or on the shroud. As seen in FIG. 4, the schematic representation of air flow shows how gold dust will flow initially to exhaust port 64 and thence will splay around the periphery of the front or inner wall 52 where it is directed to the other exhaust port 59. The exact location of these two exhaust ports may vary, except that there is at least one exhaust port near the front work area and at least one exhaust port to collect the air flows from the remainder of the gold dust debris area.

FIG. 4 shows schematically at least one air flow pattern that results from the arrangement of air exhaust ports 60 and 64 as they are positioned with respect to the lap wheel. As further seen in this FIG. 4 diagram, the lap wheel is rotated in the clockwise direction indicated by an arrow 66. When an article of gold jewelry 45 (shown in dashed lines) is positioned in the work area 46 and against the bottom surface 40 of the lap wheel, gold particulate is spewed initially generally along the lines 72 where some of it is immediately drawn into exhaust port 64 and out duct 74 as seen in FIGS. 2 and 4. Other gold particulate lapped off the article of jewelry by the bottom side of the lap wheel 38 is carried briefly by the wheel in the clockwise rotation and is spewed radially outward, but at an angle generally as shown by lines 76 due to the rotational movement. Thus, the particulate is spewed outward around most of the circumference of wheel 38, and thence into and through the front wall 52 of the shroud 50. The flow through front wall 52 is relatively uninhibited because of the large number of apertures. These apertures define an area which is at least the majority of the area of the front wall or front walls made of fence wire, may be as high as 60–90%.

FIG. 2 also shows sliding doors 67 with locks 68. By opening these doors gold dust particulate which has remained on the walls of air passageway 56 can be retrieved. For further cleaning of this shroud, locking bracket 71 and associated locking parts can be released such that the shroud can be removed, inverted and cleaned as necessary. Bracket 69 may support a lamp.

Figure 6:
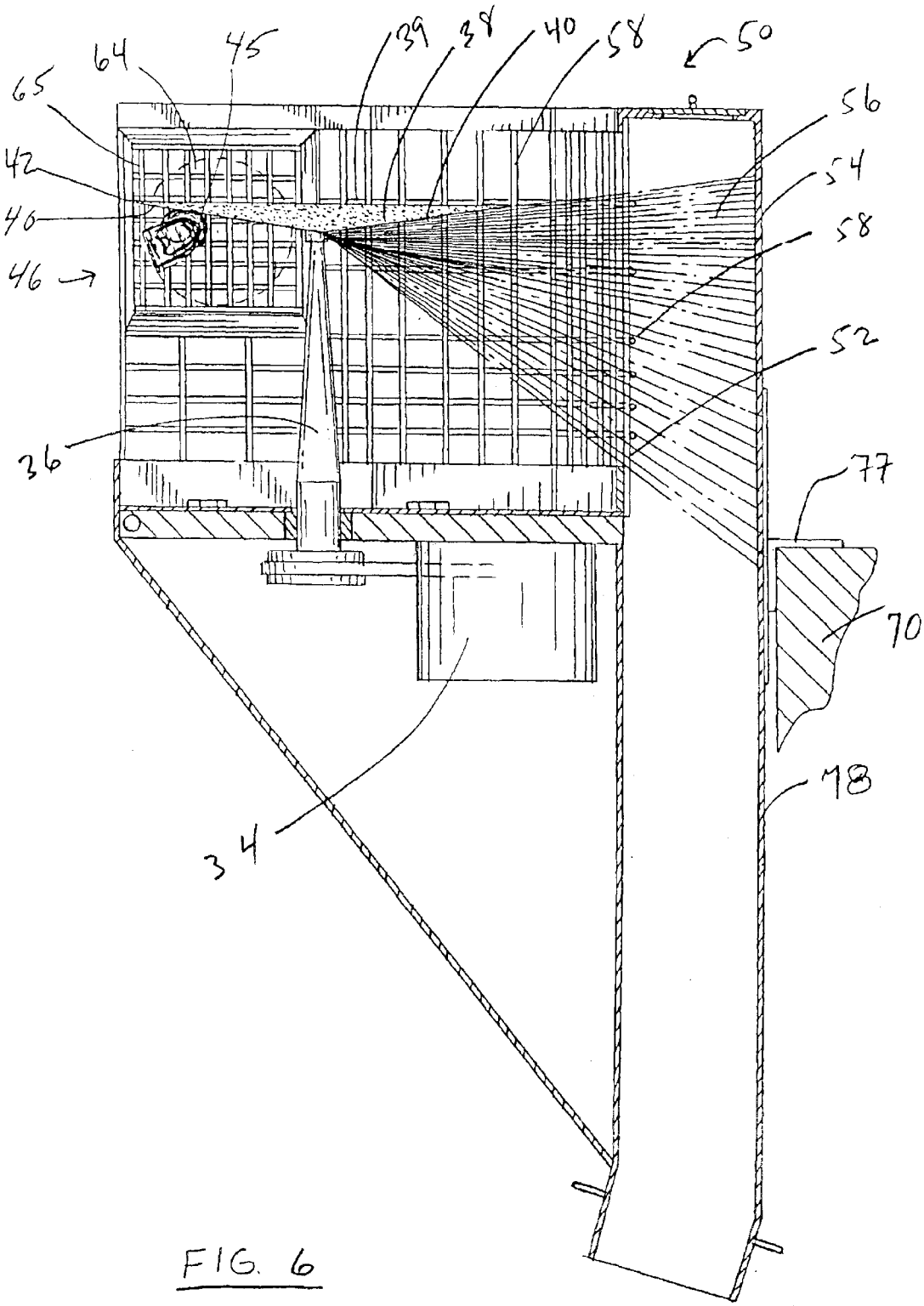
FIG. 6 is an elevation view in section similar to FIG. 3 of a second embodiment of this invention.

FIG. 6 illustrates a second embodiment of the new gold lapping machine which is mountable on a bench or wall 70 as compared to the table model of FIGS. 2–4. For convenience and clarity, parts which are the same or those in FIGS. 2–4 are given the same reference numbers. The significant differences are the rear mounting bracket 77, the extended rear air exhaust duct 78, and the absence of a base.

The shroud of this second embodiment comprises front wall 52 perforated as described earlier and rear wall 54 which is a continuous flat surface. Between these walls is an air passageway 56 similar to that in FIGS. 2–5 but without any louvers in the rear wall 54. A central exhaust port is provided in the rear wall to collect the air flows from passages 56.

Figure 7:
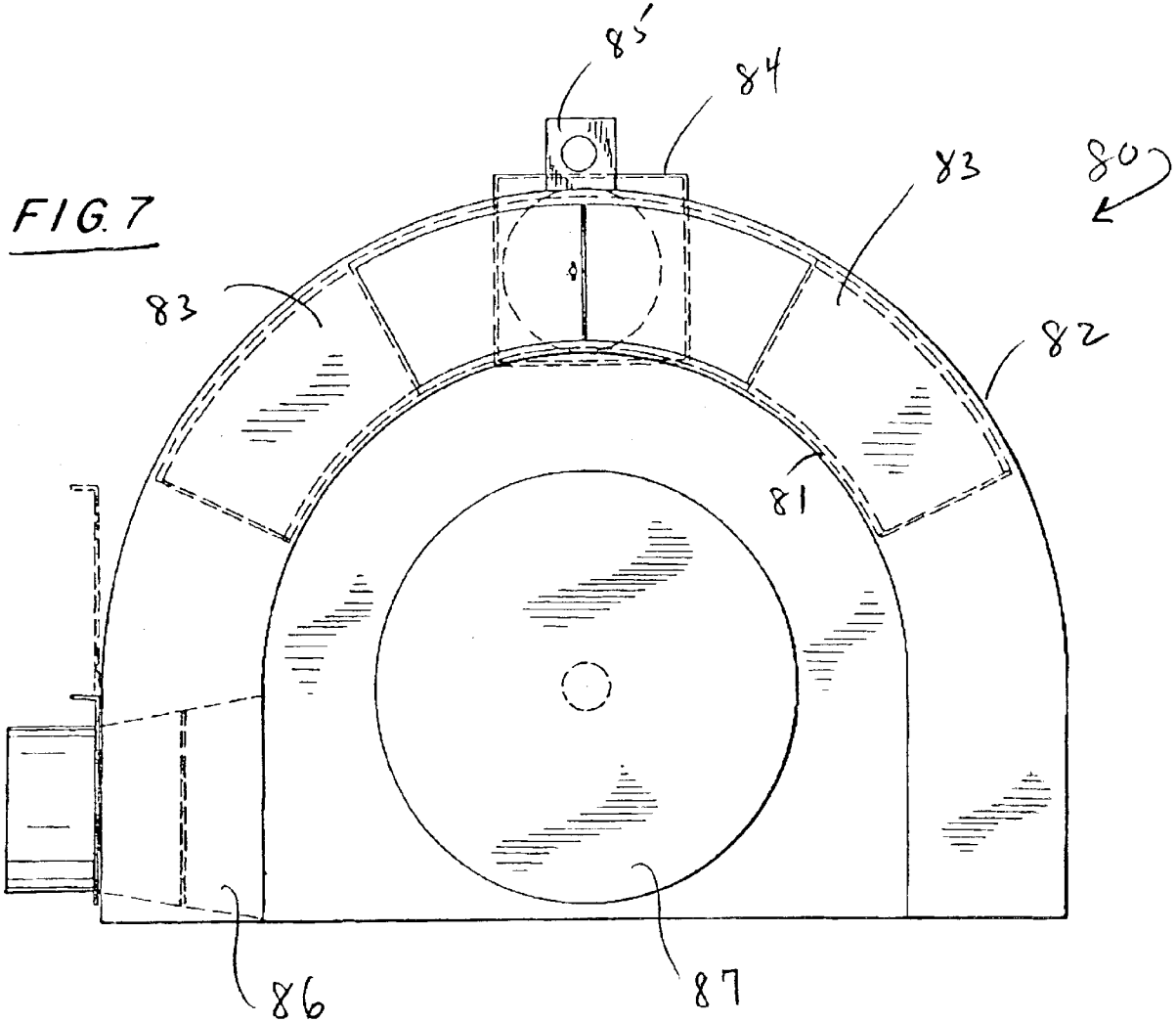
FIG. 7 is a top plan view of a third embodiment of the gold jewelry lapping machine generally similar to that of FIGS. 2 and 4, but with the front and rear panels of the shroud formed to be semi-circular and concentric.

FIG. 7 shows a further variation of the shroud construction 80 where the front and rear walls define smooth circular curves as compared to a series of flat panel segments in the shroud of FIG. 4. This new shroud 80 has a perforated, curved front wall 81, rear curved wall 82, air passages 83, rear air exhaust duct 84, rear mounting bracket 85, left side air exhaust duct 86 and lap wheel 87.

With any of these shroud arrangements these air flows have sufficient velocity (typically about 400 CFM) and pressure relative to the mass and weight of the gold particulate, to entrain and carry most of the gold particulate without much of it dropping out of the flow and onto passage floors or striking and adhering to passage walls. Consequently, most of the gold particulate can be safely retrieved by the proper owners. Suction apparatus for this exhaust system is available from many commercial sources, examples being the Handler Manufacturing Co., Inc. of Westfield, N.J. and A & M Jewelers/Tools & Supplies Co., 31 West 46$^{th}$ Street, New York, N.Y. 10036 and Grobert USA Co., Carlstadt, N.J.

With this new invention it is possible to capture a higher percentage of the gold dust produced by the gold lapping machines, which both protects the environment and the workers, and saves a great deal of money for the owners of such equipment from accidental loss or intentional theft of the gold. This invention is not limited to gold lapping machines, but is applicable also to other machines including but not limited to those with grinding, polishing, buffing and finishing wheels, all of which discharge dust and particulate from the articles being machined.

The drawings and description above illustrate preferred embodiments; however, many variations are possible within the spirit and scope of the claims appended hereto.

What is claimed is:

1. A gold jewelry lapping machine operable with a lap wheel for lapping gold jewelry and adapted to collect gold dust produced from said jewelry by said lapping machine, comprising:

(a) a base, (b) an electric motor mounted to said base, said electric motor having a rotatable output shaft extending upward and adapted to be coupled to said lap wheel which is situated above said electric motor and rotates about the axis of said output shaft, with a gold dust debris space defined as the area surrounding said lap wheel and extending from below said lap wheel downward and surrounding at least part of said output shaft, (c) a shroud comprising rear and opposite side parts that surround the rear and opposite sides of said gold dust debris space respectively, thus leaving the front of said gold dust debris space open and accessible, said shroud comprising a continuous front wall and a continuous rear wall spaced radially outward of said front wall, with air flow passages defined between said front and rear walls of said rear and side parts, said front walls of said side and rear parts of said shroud having a plurality of apertures which comprise a majority of the surface area thereof, (d) a first air exhaust port in said rear wall of said rear part of said shroud at an elevation below the bottom of said lap wheel, said air flow passages in said side parts of said shroud communicating with said air flow passage in said rear part and with said first air exhaust port, and (e) exhaust air suction means communicating with said first air exhaust port for drawing air and gold dust from said gold dust debris area.

2. A machine according to claim 1, further comprising a second air exhaust port in a first of said side parts of said shroud at an elevation at least partially below the bottom of said lap wheel, said second air exhaust port having an inlet adjacent said front wall of said first side part and an outlet in communication with said exhaust air suction means, said second air exhaust port defining an air passage separate from said air passage defined by said front and rear walls of said first side part.

3. A machine according to claim 2 wherein said air passage in said first side part between said front and rear walls thereof extends generally circumferentially from front toward the rear, and said air passage in said second air exhaust port extends generally radially.

4. A machine according to claim 3 wherein a common wall separates said air passage of said second air exhaust port and said air passage in said first side.

5. A machine according to claim 2 wherein said first and second sides of said shroud have front edges which define between them a straight line, and said lap wheel is situated with its front peripheral edge no farther forward than said straight line.

6. A machine according to claim 2 wherein in top plan view said lap wheel rotates clockwise with gold dust from gold jewelry being. lapped by the front portion of said lap wheel being spewed to the left, and wherein said second air exhaust port is on the left side of said shroud in line with gold dust spewed off said lap wheel.

7. A machine according to claim 1 wherein said apertures in a said front wall of a said shroud comprise a majority of said surface area of a said front wall.

8. A machine according to claim 1 wherein said apertures comprise an area in the range of 70–90% of the surface of a said front wall.

9. A machine according to claim 1 wherein said a front surface of each of said side and rear walls comprises wire fence material.

10. A machine according to claim 9 wherein said a wire fence comprises vertical and horizontal wires defining a grid of adjacent apertures.

11. A machine according to claim 10 wherein each of said apertures has height of about one inch and width of about one inch.

12. A machine according to claim 9 wherein said wire fence comprises steel wire.

13. A machine according to claim 1 wherein said lap wheel has four slits (a) extending radially inward from the outer perimeter part way to the center of the wheel, (b) spaced apart by 90° between each two slits, and (c) extending through said lap wheel from top to bottom.

14. A machine according to claim 13 wherein said electric motor rotates said lap wheel at a speed of approximately 3450 rpm.

15. A machine according to claim 1 wherein said exhaust air suction means creates an air flow through each of said exhaust ports of about 400 cfm.

16. A machine according to claim 2 further comprising a filter downstream of said air exhaust ports and upstream of said exhaust air suction means to capture gold dust produced from said lap wheel on jewelry being lapped.

17. A machine according to claim 1 wherein said exhaust air suction means creates an air flow at least sufficient to entrain in said air flow said gold dust produced by said lap wheel and gold jewelry being lapped.

18. A machine according to claim 17 wherein said exhaust air suction means creates an air flow at least sufficient to substantially prevent said entrained gold dust from adhering to said front and rear walls.

19. A machine according to claim 1 wherein said front and rear walls define a generally circular curve.

20. A machine according to claim 1 wherein said front and rear walls comprise a plurality of flat panels which together define a generally concave configuration.

21. A machine according to claim 1 wherein said shroud extends from said base upward to an elevation above said lap wheel.

22. A lapping machine operable with a lap wheel for lapping articles and with an air exhaust suction system adapted to collect dust produced from said article by said lapping machine, comprising:

(a) a base, (b) an electric motor mounted to said base, said electric motor having a rotatable output shaft extending upward and adapted to be coupled to said lap wheel which is situated above said electric motor and rotates about the axis of said output shaft, with a dust debris space defined as the area surrounding said lap wheel and extending from below said lap wheel downward and surrounding at least part of said output shaft, (c) a shroud comprising rear and opposite side parts that surround the rear and opposite sides of said dust debris space respectively, thus leaving the front of said dust debris space open and accessible, said shroud comprising a continuous front wall and a continuous rear wall spaced radially outward of said front wall, with air flow passages defined between said front and rear walls of said rear and side parts, said front walls of said side and rear parts of said shroud having a plurality of apertures, (d) a first air exhaust port in said rear wall of said rear part of said shroud at an elevation below the bottom of said lap wheel, said air flow passages in said side parts of said shroud communicating with said air flow passage in said rear part and with said first air exhaust port, and (e) a second air exhaust port in a first of said side parts of said shroud at an elevation at least partially below the bottom of said lap wheel, said second air exhaust port having an inlet adjacent said front wall of said first side part and an outlet in communication with said exhaust air suction means, said second air exhaust port defining an air passage separate from said air passage defined by said front and rear walls of said first side part, wherein said exhaust air suction means communicates with both said first and said second air exhaust ports for drawing air and dust from said dust debris area.

23. A lapping machine operable with a lap wheel for lapping articles and adapted to collect with an exhaust air suction means dust produced from said articles by said lapping machine, comprising:

(a) a base, (b) an electric motor mounted to said base, said electric motor having a rotatable output shaft extending upward and adapted to be coupled to said lap wheel which is situated above said electric motor and rotates about the axis of said output shaft, with a gold dust debris space defined as the area surrounding said lap wheel and extending from below said lap wheel downward and surrounding at least part of said output shaft, (c) a shroud comprising rear and opposite side parts that surround the rear and opposite sides of said gold dust debris space respectively, thus leaving the front of said gold dust debris space open and accessible, said shroud comprising a continuous front wall and a continuous rear wall spaced radially outward of said front wall, with air flow passages defined between said front and rear walls of said rear and side parts, said front walls of said side and rear parts of said shroud having a plurality of apertures which comprise a majority of the surface area thereof, said rear walls having apertures therethrough, (d) a rear manifold wall spaced outward and rearward of said rear wall defining an outer passageway, (e) a first air exhaust port in said manifold of said rear part of said shroud at an elevation below the bottom of said lap wheel, said air flow passages in said side parts of said shroud communicating with said air flow passage in said rear part and with said outer passageway and with said first air exhaust port, and (f) a second air exhaust port having an inlet adjacent said front wall of said first side part and an outlet in communication with said exhaust air suction means, said second air exhaust port defining an air passage separate from said air passage defined by said front and rear walls of said first side part, wherein said exhaust air suction means communicates with said first air exhaust port for drawing air and dust from said dust debris area.

24. A shroud for a gold jewelry lapping machine having a lap wheel and having a gold dust debris space defined as the area generally surrounding said lap wheel and extending below said lap wheel, said shroud operable with an exhaust air suction means adapted to collect gold dust produced from said jewelry by said gold jewelry lapping machine, said shroud comprising:

(a) rear and opposite side parts that surround the rear and opposite sides of said gold dust debris space respectively, thus leaving the front of said gold dust debris space open and accessible, said shroud comprising a continuous front wall and a continuous rear wall spaced radially outward of said front wall, with air flow passages defined between said front and rear walls of said rear and side parts, said front walls of said side and rear parts of said shroud having a plurality of apertures, (b) a first air exhaust port in said rear wall of said rear part of said shroud at an elevation at least partially below the bottom of said lap wheel, said air flow passages in said side parts of said shroud communicating with said air flow passage in said rear part and with said first air exhaust port, and (c) a second air exhaust port in a first of said side parts of said shroud at an elevation at least partially below the bottom of said lap wheel, said second air exhaust port having an inlet adjacent said front wall of said first side part and an outlet in communication with said exhaust air suction means, said second air exhaust port defining an air passage separate from said air passage defined by said front and rear walls of said first side part, wherein said exhaust air suction means communicates with both said first and said second air exhaust ports for drawing air and gold dust from said gold dust debris area.

* * * * *